US012708195B2

(12) United States Patent
Davies

(10) Patent No.: US 12,708,195 B2
(45) Date of Patent: Aug. 18, 2026

(54) MOUTH CARE DEVICE

(71) Applicant: Rosalyn Anne Harris Davies, Swansea (GB)

(72) Inventor: Rosalyn Anne Harris Davies, Swansea (GB)

( * ) Notice: Subject to any disclaimer, the term of this patent is extended or adjusted under 35 U.S.C. 154(b) by 498 days.

(21) Appl. No.: 18/064,603

(22) Filed: Dec. 12, 2022

(65) Prior Publication Data

US 2023/0180923 A1 Jun. 15, 2023

(30) Foreign Application Priority Data

Dec. 10, 2021 (GB) ..... 2117925

(51) Int. Cl.
*A46B 9/02* (2006.01)
*A46B 1/00* (2006.01)
(Continued)

(52) U.S. Cl.
CPC ..... *A46B 9/02* (2013.01); *A46B 5/0095* (2013.01); *A46B 2200/01* (2013.01); *A46B 2200/1066* (2013.01)

(58) Field of Classification Search
CPC . A46B 9/005; A46B 2200/01; A46B 2200/00; A46B 2200/10; A46B 2200/108; A46B 2200/1026; A46B 2200/1066; A46B 2200/1073; A46B 2200/1086; A46B 9/02; A46B 5/0095; A46B 3/005; A46B 1/00;
(Continued)

(56) References Cited

U.S. PATENT DOCUMENTS 1,327,757 A * 1/1920 Eggers ..... A46B 11/063 401/28
4,039,261 A * 8/1977 Evans ..... A46B 1/00 401/268

(Continued)

FOREIGN PATENT DOCUMENTS

CN 105142585 A * 12/2015 ..... A46B 9/005
GB 2381444 11/2001

(Continued)

OTHER PUBLICATIONS

Search Report from UKIPO dated May 23, 2022, 2 pages.

*Primary Examiner* — Marc Carlson
(74) *Attorney, Agent, or Firm* — Heslin Rothenberg Farley & Mesiti P.C.

(57) ABSTRACT

There is provided a mouth care device comprising a unitary integrally moulded elongate shaft forming an elongate handle having a proximal end, and a distal end of circular cross-section; and a unitary integrally moulded head comprising a body portion encircling and fused to the distal end. The integrally moulded head also comprises a plurality of rows of integral flexible filaments, each such row extending longitudinally of the shaft and comprising at least five of the flexible filaments. The rows of flexible filaments are distributed around the head, and each of the flexible filaments is of non-absorbent material and of uniform diameter, extending transversely relative to the integrally moulded head. The mouth care device also comprises a continuous internal channel running from a proximal opening in the proximal end of the device to a distal opening located at the distal end of the device.

12 Claims, 3 Drawing Sheets

(51) Int. Cl.
*A46B 3/00* (2006.01)
*A46B 5/00* (2006.01)

(58) Field of Classification Search
CPC ..... A61C 17/22; A61C 17/222; A61C 17/228; A61C 17/00
See application file for complete search history.

(56) References Cited

U.S. PATENT DOCUMENTS

| | | | | | |
|---|---|---|---|---|---|
| 6,129,547 | A * | 10/2000 | Cise | A61C 17/0208 | 601/162 |
| 6,238,213 | B1 * | 5/2001 | Young | A61C 17/08 | 433/91 |
| 2006/0165473 | A1 * | 7/2006 | Hohlbein | A46B 9/04 | 401/270 |
| 2011/0151404 | A1 * | 6/2011 | Dombrowski | A46B 15/00 | 433/96 |
| 2014/0008837 | A1 * | 1/2014 | Eatherton | B29C 45/1671 | 264/243 |

FOREIGN PATENT DOCUMENTS

| | | | | |
|---|---|---|---|---|
| GB | 2381444 A * | 5/2003 | | A46B 5/0079 |
| GB | 2526655 | 12/2015 | | |
| GB | 2526655 A * | 12/2015 | | A46B 5/0029 |

* cited by examiner

MOUTH CARE DEVICE

CROSS REFERENCE TO RELATED APPLICATIONS

This application claims priority benefit from Great Britain Application No. 2117925.4 filed on Dec. 10, 2021, entitled "Mouth Care Device", which is incorporated herein by reference in its entirety.

FIELD OF THE INVENTION

The present invention concerns a mouth care device (also known as an oral hygiene device).

BACKGROUND OF THE INVENTION

Mouth care is an important part of personal hygiene: inadequate mouth care can have an adverse effect on a person's general health and wellbeing.

People who are physically, mentally or medically compromised will often require help from another person to provide their mouth care for them. Evidence suggests this can be very challenging both for the person and the care provider. Many people with dysphagia, poor muscle control, and limited cognitive function often lack the capacity to take care of their own mouth, thus resulting in halitosis—bad breath. For care providers, this offensive smell can be very off putting and result in mouth care not being delivered. There is clear evidence that people with a learning disability have poorer oral health than the general population, and greater levels of periodontitis. People with challenging neurological behaviours often have a bite reflex which can result in harm to themselves and the care provider.

People who are medically compromised often suffer from, for example, extreme sensitivity, xerostomia, excess salivation severe soreness and ulceration due to a side effect of medication. Providing mouth care with a conventional nylon bristle toothbrush is very difficult, and often not carried out for that reason. Failure to manage mouth care for people with complex needs is linked to deteriorations in oral health and to an increase in oral disease. Oral disease, particularly periodontitis, is linked to systemic diseases such as coronary heart disease, stroke, aspiration pneumonia, certain cancers etc. If mouth care is not provided effectively, people are at risk of increasing health problems.

There are disposable devices on the market that have been developed to meet the need of oral care for people with complex needs. For example, known such disposable oral care devices essentially comprise a head comprising a foam mouth sponge, or fabric or tissue, the head being mounted on a hard stiff handle, or "stick", similar to a lollipop ("popsicle") stick.

Problems have been identified with such devices, in that the head can become detached from the handle. An MHRA medical device alert (http://www.mhra.gov.uk) was issued in April 2012 stating 'the foam heads of oral swabs may detach from the stick during use. This may present a choking risk for patients'. In Wales, the Chief Nursing Officer, Chief Dental Officer and Chief Medical Officer withdrew such known foam devices from all NHS establishments.

Furthermore, foam sponges have historically been used to remove plaque bacteria from the tooth surface. However, the typical and distinctive quality of the sponge results in insufficient texture to effectively remove plaque bacteria from the surface of the teeth and to prevent gum disease (gingivitis and periodontitis). The use of a sponge-based oral care device can therefore result in poor oral care and increased oral disease.

A fabric based oral hygiene device is disclosed in US2003/0108846, in which the device comprises an "elongated member" (or handle) and one or more absorbent swabs of non-woven fabric secured to an end thereof. Again problems can arise with detachment of the fabric from the end of the handle. Such a device should, in good clinical practice, be used once and then disposed of.

The present invention is an improvement of the oral hygiene device disclosed in GB2526655B which is designed to be used twice in a twelve hour period. Moisture can lead to bacterial build-up and as the device is re-used, this could be a problem. It is therefore desirable to reduce the moisture on the device after the first use in order to reduce the bacterial load of the device before the second use.

SUMMARY OF THE INVENTION

The present invention therefore provides a disposable oral hygiene (or mouth care) device, the device comprising:

a) a unitary integrally moulded elongate shaft forming an elongate handle having a proximal end (for gripping by the hand of a user), and a distal end (for insertion by the user in a patient's mouth) of circular cross-section; wherein the shaft comprises an internal shaft channel having a proximal opening located at the proximal end of the device, and a distal opening located at the distal end of the device (for insertion of a suction device to remove fluids such as saliva); and b) a unitary integrally moulded head, the head comprising a body portion encircling (surrounding), and fused to, the distal end of the shaft, and also a plurality of rows of integral flexible filaments, each said row extending longitudinally of the shaft and comprising at least five of the filaments, the rows of the filaments being distributed around the head, and the filaments each being of non-absorbent material and of uniform diameter, extending transversely relative to the integrally moulded head; and c) the head further comprises an internal head channel extending from a distal end of the head to an external surface of the head, the head channel being aligned with the body channel so as to form a continuous channel.

By "non-absorbent" we mean in the ambient environment of a user's mouth. Because the flexible filaments are, as indicated, non-absorbent, it is an advantageous feature of the device according to the invention that liquid may be entrained and carried by the flexible filaments, in the interstices between adjacent rows of the flexible filaments.

The integral flexible filaments are all integral with the head. The flexible filaments and head are therefore formed as a one piece moulding, moulded around and fused to the distal end of the shaft (the latter shaft being a previously formed unitary integrally formed moulding). The two mouldings thus effectively form a single unitary moulding, which thereby acts to prevent the head becoming detached from the handle.

The substantially continuous internal channel allows for the insertion of a suction device which can reduce moisture on and around the device which may reduce build-up of bacteria.

The head channel may comprise a first opening and a second opening. Preferably the first opening is located on a distal end of the head, and the second opening is located on a surface of the head. The first and second openings allow air flow through the device for a suction apparatus inserted into the channel in the shaft. More preferably, the opening on the surface of the head has been created by the omission of one or more filaments. The opening allows for a clear route in the internal shaft channel, giving access to a suction device when inserted.

The handle of the device according to the invention is preferably made of a polyolefin thermoplastic polymer, which polymer is hygienic (it can be sterile immediately after moulding) and has a history of use for similar products such as toothbrushes. The material choice should be based on a number of criteria, namely its physiological acceptability and its physical properties. Specifically, the material chosen for the handle should be soft enough to prevent damage to the teeth of patients in the event of involuntary bite reflex during oral health care and carrying out of oral hygiene operations. The handle may have a smooth texture which permits it to be used as a bite pad for patients who may have a bite reflex.

The material of the handle should be malleable or flexible enough to enable it to be bent by the user (that is, formed by the user into a curved or angled shape), in order to aid access to the mouth of the patient; the material should still be robust enough to allow sufficient pressure to be applied during use in oral hygiene. Such flexibility permits angling the device according to the invention for maximum reach inside the mouth of the patient. Other ergonomic handle features may also be included. The handle may comprise a curved portion separating the distal end from the proximal end to improve access to the mouth of the patient. (Of course, in some circumstances the "user" and the "patient" may be one and the same person.)

The proximal end of the handle of the device according to the invention may be shaped to enhance the user's grip, or that end may be provided with grip formations such as grooves or the like.

As indicated, the distal end of the handle of the device according to the invention has circular cross-section; this cross-section may be constant over at least part of the extent of the head (in which case the relevant part may be cylindrical), or it may vary along the length thereof. When the cross-section of the handle varies, the head may be taper towards the distal end of the head; it is particularly preferred that the head is of conical or (more preferably) of frustoconical shape, tapering inwardly towards a distal end face.

It is particularly preferred that the head of the device according to the invention has a distal end face which should be smooth, and the distal end face should furthermore preferably be either flat or slightly convex, in order to further avoid damage to delicate tissue in the user's mouth. It is further preferred that the distal end face of the head should be devoid of (free of) the flexible filaments (such as those described above).

The distal end of the shaft (and also the moulded head as indicated above), are both preferably frustoconical in shape, so as to mirror the general shape of the patient's palate, and to allow for easy access to the sulcus of the cheeks and back of the tongue of the patient.

The moulded head, together with the rows of integral flexible filaments as described, are generally formed around the handle at high temperature, whilst the material forming the moulded head and flexible filaments is in its molten state. Bonding of the two parts (the head and the handle) may be achieved utilising a mechanical key on the handle portion. Because melted polymer materials shrink on cooling, such shrinkage has the advantageous result that the flexible filament portion pulls down tightly onto the handle and grips onto the mechanical key, so as to prevent the head coming loose in operation. It is preferred that the head forms a shroud, such that the resulting shroud circumferentially encircles the distal end of the handle.

The head and the integral flexible filaments are preferably integrally moulded from a thermoplastic elastomer, which (advantageously) is generally a food contact grade material. Such thermoplastic elastomers, which are generally inherently non-absorbent, typically exhibit good tensile and tear strength, whilst being soft and flexible, in order to ensure that the head of the device does not create discomfort for the patient during use in a cleaning operation. Such thermoplastic elastomers also give a good bond to the polyolefin constituting the handle, which adds to the mechanical key effect and helps to prevent the head from becoming detached from the handle.

It is further preferred that the head, like the flexible filaments as described above, should be of non-absorbent material.

The integral flexible filaments may be textured; for example, they may include integral minor ridges, which allow for crusty secretions and food debris to stick to each filament for easy removal. Because the filaments are flexible, they are, of course, not suitable for applications, such as plaque removal, which would require hard rubbing.

In some embodiments of the invention, the rows of flexible filaments may be arranged in at least part-helical (or part-spiral) manner, in which case each of the respective plurality of rows may comprise a successive notional turn of the relevant helix or spiral. Such notional turns of the helix or spiral thus extend both around the head and along the length thereof.

Alternatively, each of the rows of flexible filaments may be arranged in a linear fashion. In this case, the number of rows of integral filaments on the head, and their alignment, are preferably both selected so that there is no more than 60° separation between adjacent linear rows. It is particularly preferred that a selected plurality of rows are parallel to one another. It is further preferred that each flexible filament in a row is parallel to each other flexible filament in that row. In a further preferred embodiment, the free (tissue-contacting) ends of the integrally moulded flexible filaments are either flat or slightly convex, in order to avoid damage to the user's mouth during an oral hygiene operation.

It is particularly preferred that at least some of the integral flexible filaments extend substantially perpendicular to a longitudinal axis of the shaft.

The oral hygiene device according to the invention is preferably disposable; that is, the device is intended to be used for a period of up to 12 hours and then discarded. It is, however, an advantage of the device according to the invention that it can be used more than once during a 12 hour period; by way of contrast, conventional oral hygiene devices can be used only once and must then be discarded because of the risk of detachment of the head portions thereof.

The oral hygiene device according to the invention is furthermore designed to support patients with complex health needs, and enable them to have their mouths cleaned by respective users each employing a device according to the invention, thereby to achieve a clean and healthy mouth for the relevant patient. The device according to the invention is specifically designed to assist "users" who are carers and care providers, and who carry out mouth care for others (namely for patients).

However, it is also possible for the "user" (that is, the person who manually grips the handle) to be the same as the "patient" (that is the person whose mouth is to be cleaned).

The oral hygiene device according to the invention is generally not intended to remove plaque bacteria from the tooth surface, there being many such products on the market that fulfil that role. Specifically, the filaments of the device according to the invention are flexible and therefore unsuitable for applications where significant rubbing of, for example, tooth surfaces is required However, the device according to the invention preferably has three main applications, as follows:

a. To cleanse the mouth, so as to enable soft tissues and mucosa to be freed from food debris, oral bacteria and sticky saliva secretions;

b. To assist hydration, so as to be a carrier for aiding hydration of the mouth and soft tissues either by carrying thin liquids such as water, mouth rinses or water based gels etc; and c. To assist with oral desensitisation for people who have become averse to having their teeth and mouth brushed with a toothbrush.

In order to carry out the function of cleansing the patient's mouth, the head (together with the flexible filaments) is typically rubbed and rotated in a circular motion over the part of the user's oral cavity to be cleansed (namely the tongue, oral mucosa and soft gingivae) to remove food, debris and sticky secretions.

In order to help in carrying out the function of assisting hydration, the flexible filaments of the device according to the invention are preferably strategically placed (in rows, as indicated above) in order to ensure maximum holding of thin liquids such as water, mouth rinses and water based gels. The liquids of this nature are held between adjacent rows of flexible, non-absorbent filaments, and not (as in the case of prior art oral hygiene devices comprising elongate handles and swabs or sponges) by an absorbent head.

In order to assist with oral desensitisation for patients who have become averse to having their teeth and mouth brushed with a toothbrush, the device according to the invention can be used to rub and stimulate the patient's lips, mouth and tongue, and the tactile flexible filaments can be massaged around the mouth area to "wake up" the muscles of the mouth for patients with low tone or apraxia.

The present invention therefore further comprises a method of oral hygiene, in which a user inserts the head end of a device according to the invention into the mouth of a patient, and then uses the flexible filaments at the head end to rub internal surfaces of the patient's mouth, such as the tongue, oral mucosa and soft gingivae.

BRIEF DESCRIPTION OF THE DRAWINGS

The accompanying drawings, which are incorporated in and constitute a part of the specification, illustrate embodiments of the disclosure and together with the detailed description herein, serve to explain the principles of the disclosure. It is emphasized that, in accordance with the standard practice in the industry, various features are not drawn to scale. In fact, the dimensions of the various features may be arbitrarily increased or reduced for clarity of discussion. The drawings are only for purposes of illustrating preferred embodiments and are not to be construed as limiting the disclosure.

DETAILED DESCRIPTION FOR CARRYING OUT THE INVENTION

Figure 1:
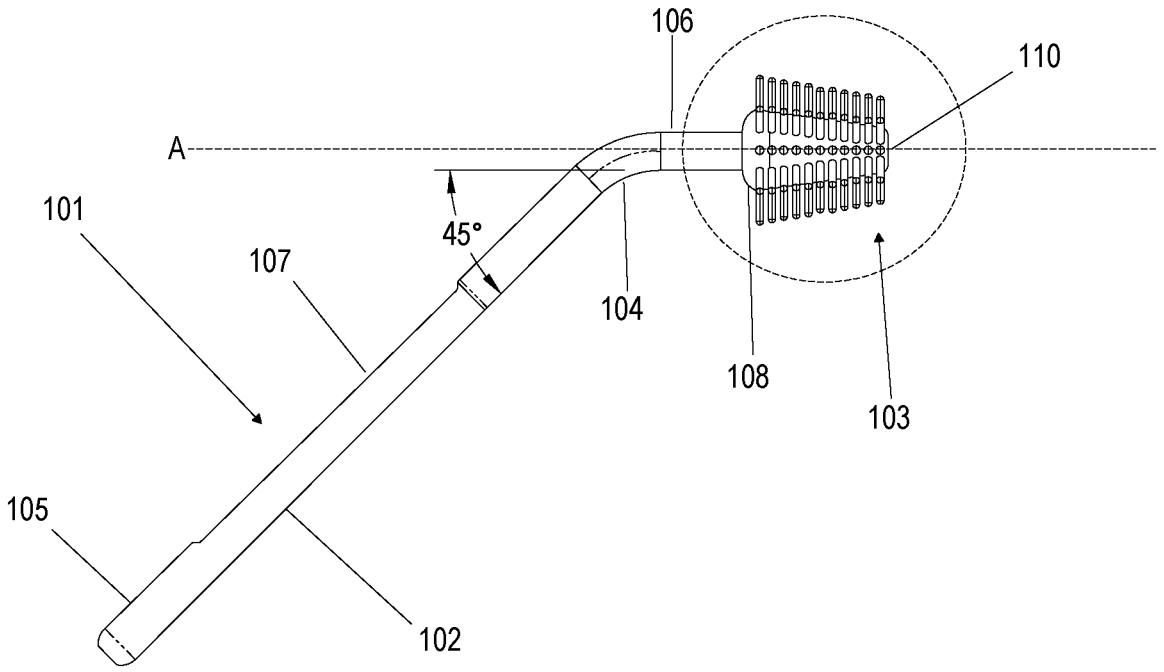
FIG. 1 is a perspective view of an exemplary oral hygiene device, in accordance with an aspect of the present disclosure.

Referring to the drawings, in which like parts are denoted throughout by like reference numerals, there is shown a disposable oral hygiene device 101 comprising a handle portion 102 and a head portion 103.

The handle portion 102 as shown has a unitary, integrally moulded, elongate shaft having a curved section 104, a hand grip end 105 and an opposed end 106, longitudinally separated from hand grip end 105, to which is moulded the head portion 103, which is to be inserted into a patient's mouth. The curved section 104 has an angle of 45°. The handle portion 102 is mainly of circular cross-section, but in the illustrated embodiment, it further includes a cut-out generally flat portion 107 to aid gripping. The handle portion 102 also comprises an internal shaft channel running from a proximal opening at the proximal end of the handle portion 102 to the head channel.

Figure 2:
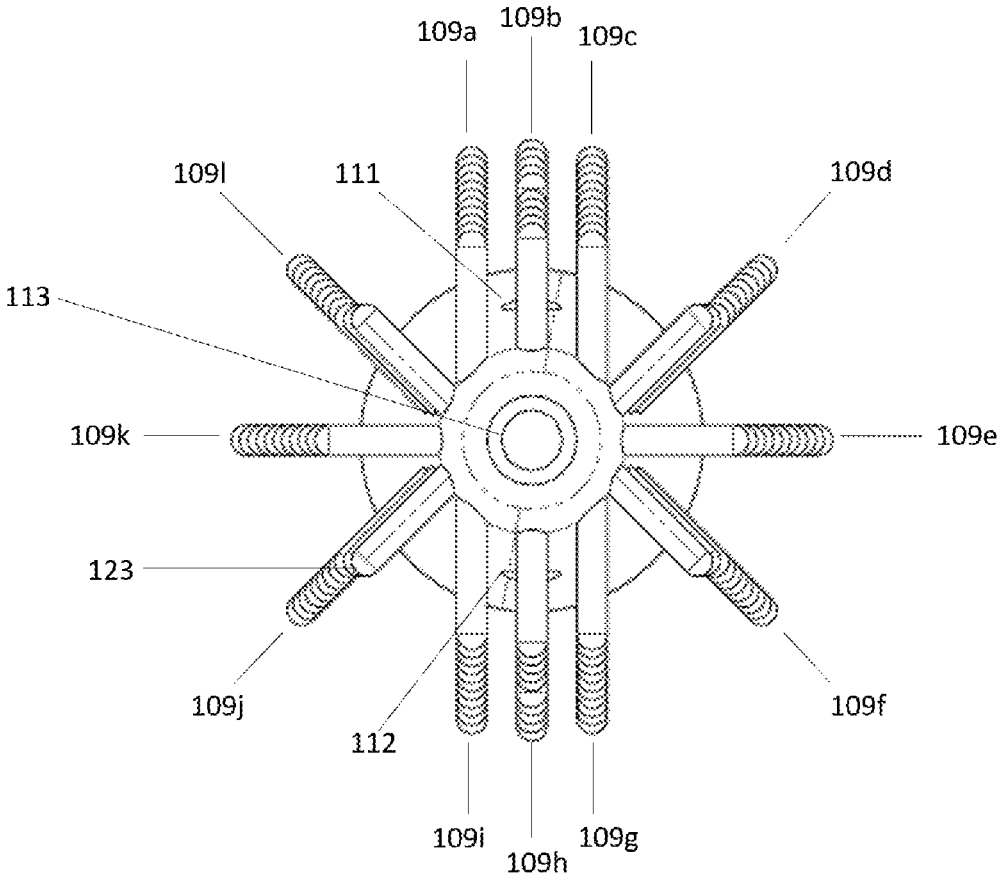
FIG. 2 is an end view of the head region of the device of FIG. 1, in accordance with an aspect of the present disclosure.

The head portion 103 is itself a unitary integral moulding; it comprises a body portion 108 encircling (surrounding), and fused to, the opposed end 106 of handle portion 102, and also (as shown—see especially FIG. 2) twelve rows 109*a*, 109*b*, 109*c*, 109*d*, 109*e*, 109*f*, 109*g*, 109*h*, 109*i*, 109*j*, 109*k*, 1091 of integral flexible filaments each of which is generally cylindrical shape. The head portion 103 further has a flat disc shaped end 110, so shaped in order to avoid damage to a patient's mouth during use of the illustrated exemplary device.

Figure 3:
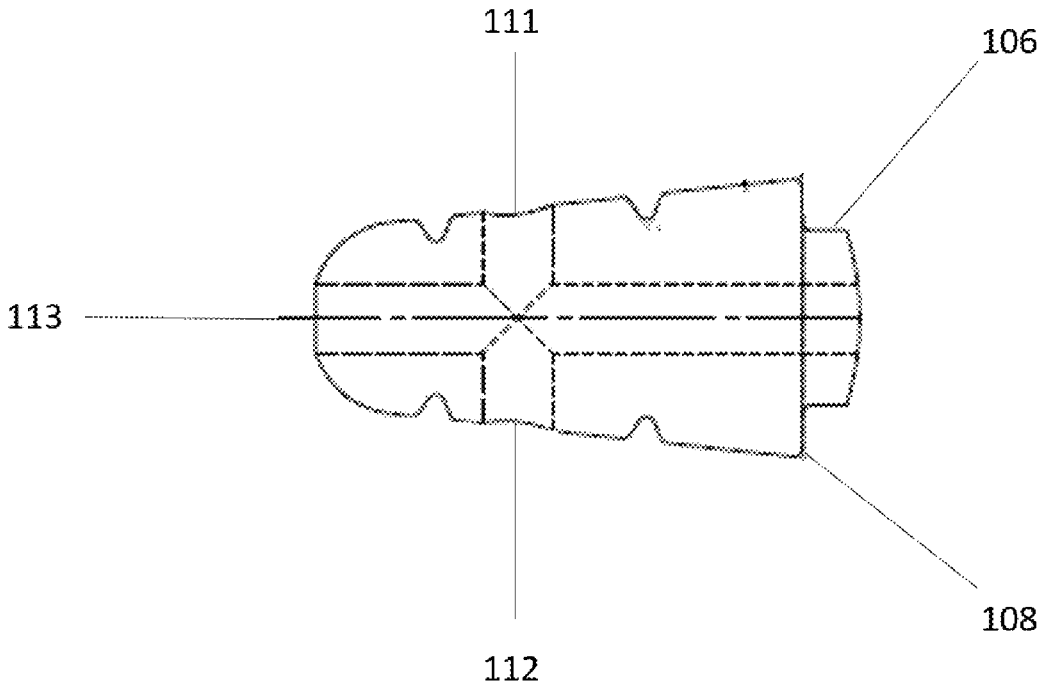
FIG. 3 is a cross sectional view of the head region of the device of FIG. 1 along the axis A-A in FIG. 1 with the filaments not shown, in accordance with an aspect of the present disclosure.

The head portion 103 also comprises an internal head channel (see FIG. 3). There is a first opening 111 on the surface of the head portion 108, a second opening 112 on the surface of the head portion 108 and a third opening 113 on the distal end of the head portion 108.

Each such row of flexible filaments in the illustrated embodiment extends longitudinally and parallel to the distal end 106 of the handle portion 102. As shown in the illustrated embodiment (again see FIG. 2) ten of the twelve rows contain eleven such filaments of uniform diameter, extending transversely relative to the head portion 108 and the distal end 106 of the handle portion 102. Some of the illustrated rows are perpendicular to the longitudinal axis of the distal end 106 of the handle portion 102. Two of the rows 109*b* and 109*h* have ten filaments with the middle filament omitted to allow for the first opening 111 on the surface of the head portion 103 and the second opening 112 on the surface of the head portion 103.

The rows of flexible filaments are distributed around the head portion 108; in the illustrated embodiment (see FIG. 2) there are two opposed sets of three generally parallel rows 9*a*, 9*b*, 9*c*; and 9*g*, 9*h*, 9*i*, respectively; and two opposed sets 9*d*, 9*e*, 9*f*; and 9*j*, 9*k*, 91, respectively, which are at successively increased angles (with approximately 60° separation between adjacent such rows).

Each row of flexible filaments is substantially co-planar with a corresponding row of flexible filaments on the opposite side of the head portion 108; thus row 9*a* is coplanar with row 9*i*; row 9*b* is coplanar with row 9*h*; and row 9*c* is coplanar with row 9*g*. Furthermore, row 9*d* is coplanar with row 9*j*; row 9*e* is coplanar with row 9*k*; and row 9*f* is coplanar with row 9*l*.

The ends 123 of each of the flexible filaments are, as illustrated flat; also as illustrated, some of the flexible filaments are perpendicular to the distal end 106 of the handle portion 102.

What is claimed is:

1. An oral hygiene device comprising:

a unitary integrally moulded elongate shaft forming an elongate handle having a proximal end, and a distal end of circular cross-section;

wherein the shaft comprises an internal shaft channel having a proximal opening located at the proximal end of the device, and a distal opening located at the distal end of the device; and a unitary integrally moulded head comprising:

a body portion encircling and fused to the distal end of the shaft;

a plurality of rows of integral flexible filaments, each said row extending longitudinally of the shaft and comprising at least five of the filaments, the rows of filaments being distributed around the head, and each of the filaments being of non-absorbent material and of uniform diameter, extending transversely relative to the integrally moulded head; and an internal head channel extending from a proximal end of the head to a first opening defining a distal end of the head, the head channel being aligned with the body channel so as to form a continuous channel, wherein the first opening comprises a radius, wherein the radius of the first opening defines a radius of the continuous channel.

2. The device according to claim 1, wherein the head channel comprises a second opening.

3. The device according to claim 2, wherein the second opening is located on a surface of the head.

4. The device according to claim 3, wherein the opening on the surface of the head has been created by the omission of one or more filaments.

5. The device according to claim 1, wherein the handle is malleable or flexible enough to enable it to be bent in the mouth of a patient.

6. The device according to claim 1, wherein the proximal end of the handle is shaped to enhance grip, or is provided with at least one grip formation.

7. The device according to claim 1, wherein the distal end of the elongate handle has a circular cross-section.

8. The device according to claim 1, wherein the moulded head tapers towards the distal end of the head.

9. The device according to claim 8, wherein the moulded head is of frustoconical shape, tapering inwardly towards a face at the free end.

10. The device according to claim 9, wherein the face at the free end is smooth and either flat or convex.

11. The device according to claim 1, wherein the handle comprises curved portion separating the distal end from the proximal end.

12. The device according to claim 1, wherein the filaments are positioned exclusively between the proximal end of the head and the distal end of the head.

* * * * *